US006533890B1

(12) United States Patent
Berger et al.

(10) Patent No.: US 6,533,890 B1
(45) Date of Patent: Mar. 18, 2003

(54) METHOD AND STEAM PRESS FOR THE PRODUCTION OF BOARDS OF LIGNEOUS MATERIAL

(75) Inventors: Susanne Berger, Eppingen (DE); Friedrich B. Bielfeldt, Pähl (DE)

(73) Assignee: Maschinenfabrik J. Dieffenbacher GmbH & Co. (DE)

( * ) Notice: Subject to any disclaimer, the term of this patent is extended or adjusted under 35 U.S.C. 154(b) by 0 days.

(21) Appl. No.: 09/722,272

(22) Filed: Nov. 28, 2000

(30) Foreign Application Priority Data

Nov. 28, 1999 (DE) ..... 199 57 265

(51) Int. Cl.[7] ..... B27N 3/20

(52) U.S. Cl. ..... 156/296; 156/583.1; 156/583.91; 264/109; 264/294.4; 264/297.8; 264/319

(58) Field of Search ..... 156/296, 242, 156/553.1, 583.91; 264/109, 297.4, 297.6, 297.8, 319; 425/112, 125, 177, 406, 440, 412

(56) References Cited

U.S. PATENT DOCUMENTS

| | | | | |
|---|---|---|---|---|
| 4,850,849 A | | 7/1989 | Hsu | |
| 4,854,994 A | * | 8/1989 | Breiter et al. | 100/195 |
| 5,096,409 A | * | 3/1992 | Stofko | 100/297 |

FOREIGN PATENT DOCUMENTS

| | | |
|---|---|---|
| EP | 0 339 952 | 11/1989 |

* cited by examiner

*Primary Examiner*—Sam Chuan Yao
(74) *Attorney, Agent, or Firm*—Foley & Lardner

(57) ABSTRACT

A method and apparatus for the production of ligneous material boards characterized by a positive separation of the press platen applying the compression pressure from the mat at the frame sealing the outer margin, so that the press pressure is applied independently of the pressure required for the sealing.

4 Claims, 3 Drawing Sheets

METHOD AND STEAM PRESS FOR THE PRODUCTION OF BOARDS OF LIGNEOUS MATERIAL

BACKGROUND OF THE INVENTION

The invention relates to a method for the production of boards of ligneous material and to a steam press for the practice of the method.

In a known method according to EP 0 339 952 a preliminary compression is at first applied to the mat of raw material and steam is introduced into the press chamber alternately from the top down and from the bottom up. This has the advantage that the heating of the mat by the transfer of heat from the steam to the mat material takes place rapidly and the cycling time can be reduced by as much as 75%. Sealing from the atmosphere is provided by a frame which is tightly anchored to the margin of the upper press platen. Two pressure bars of different thickness, 6 and 12 mm, are used for the frame. In the case of a changeover of production, the frame is replaced. This procedure takes about two days, and in addition to installation personnel it requires that the press be shut down with the attendant loss of production, since the frame is composed of several bars. The force applied by the piston-and-cylinder system is divided into a force acting on the actual mat of raw material and a force acting on the material under the sealing bars. Assuming that a uniform depth of material is applied over the entire width of the press, a higher pressure on the material is established under the sealing bars. As the state of compression advances, the ratio of force $F_{pressure\ bar}$ to $F_{chipboard}$ shifts toward ever increasing values. This effect can be seen in exponential compression curves (layer depth over press pressure).

The disadvantages of a geometrically and permanently anchored frame on the press platen are:

During the preliminary compression of the actual raw material mat to establish a permeability suitable for the mass flow of the steam, a certain material density is established under the bar by the compression curve, according to the height of the bar selected, to seal it off from the atmosphere, but depending on the steam pressure it may not be sufficient to prevent the leakage of steam; in other words, the material density under the pressure bars might not suffice to prevent the escape of steam from the press area.

During the main compression, the actual board is to be brought down to the desired thickness. The force applied by the main cylinder is here again divided between the force on the pressure bars and the force on the platen.

Due to the pressure which increases exponentially as compression increases, the pressure under the pressure bars increases considerably more than it does on the actual product. For this reason, for the production of greater final board thicknesses it is essential to change the pressure bars to different thicknesses. The press pressure on the board itself is limited, the pressure under the pressure bars increases rapidly, and this can also lead to material damages at the upper and lower press platen. When the press is opened, the ligneous material board still has an elevated temperature level and the residual water contained in the board evaporates. The raising of the upper press platen is simultaneous with the raising of the pressure bar and the expansion steam escapes to the sides. This results in considerable soiling of the steam press, especially the cylinder surfaces. To avoid blowouts in the board, before raising the upper press platen a relief period of about one minute must be observed. This steam expansion process can be abbreviated in some cases by the use of a vacuum.

The lateral escape of the expanded steam is a disadvantage, because it leads to considerable soiling of the steam press as well as its surroundings, and long expansion periods are necessary before the steam press is opened so as to prevent blowouts.

SUMMARY OF THE INVENTION

The invention is addressed to the problem of devising a method in which the escape of steam from the press space is prevented in every phase of the compression of the mat, in which no damage or contamination of the steam press occurs, and in which the described disadvantages do not appear, and also the problem of creating a steam press for the practice of the method.

The solution of this problem includes a separation of the press platen applying the pressure from the frame sealing the mat at its outer margin, so that the press pressure is applied independently of the pressure necessary for the edge sealing.

A steam press for the practice of the method of the invention is characterized by the fact that the frame is configured as a sealing frame in contact with the lateral walls of the moving press platen, can be raised and lowered thereon by actuators, and grips the mat at its outer margin, and that the sealing frame can be controlled as to pressure, time and motion, independently of the application of pressure to the moving press platen.

The separation of the actual pressing surface and sealing frame by hydraulic actuators for control of stroke and pressure independent of the press movement results in the advantage that the press pressure on the mat can be optimized through the entire processing time as required. The sealing pressure is independent of the press pressure and can be kept constant or adapted to requirements throughout the pressing period, independently of the actual board thickness.

In the preliminary compression phase the preliminary pressure on the platen can be variable, that is to say, it can be adjusted regardless of the preliminary compression under the sealing frame. An optimum setting of the permeability of the mat can be established by optimizing the sealing pressure and material density under the sealing frame. This sealing pressure can be sustained throughout the process.

In the main compression, a defined and measurable pressure on the mat can be established as required. Due to the defined pressure conditions uncontrolled mechanical deformation or destruction of the steam press can no longer occur.

Before the press is opened, the upper press platen can be set for a compression pressure of from $\leqq 4$ N/mm$^2$ to an expansion or steam relief pressure of 0.5 N/mm$^2$, while the sealing frame can be held down on the compressed board. The expansion or steam relief pressure is equal to or greater than the transverse tensile strength in the press platen corresponding to the glue setting that has taken place up to this moment of the pressing process. The expanding steam can then be relieved into the space between the board and the upper press platen and be carried out through the nozzles. The expansion counter-pressure of the upper press platen is controlled over a distance/pressure gradient of from $\geqq 0.5$ N/mm$^2$ toward 0 N/mm$^2$. After that, the press is opened. It is especially advantageous that the expansion steam can no longer escape laterally and thus contamination of the press and its surroundings can be prevented by the controlled removal of the steam. Also, blowouts in the middle and cover layers are prevented, and the formerly necessary steam relief period of one minute has been saved, without the need to use the vacuum systems of the former state of the art.

Additional advantages of the invention are protection of the equipment by the sealing provided by the controlled sealing frame at all board thicknesses, reduction of the steaming time by controlling permeability and thus increasing the throughput, shortening of the steam escape period which can be further optimized by adapting the distance/pressure control gradients of the upper press platen to larger steam carrying cross sections, the loss of production and elimination of the need for personnel for product changes (changing the pressure bars) because a flying or automated change has become possible, production of LDF (low-density fiberboard) with a density lower than 500 kg/m$^3$ on account of the independently controllable pressure and distances between the upper press platen and the sealing frame, optimization of the pressing process for MDF (medium-density fiberboard), the use of higher steam pressures (>16 bar) is possible resulting in a reduction of the consumption of industrial binding agent by activating the lignin contained in wood as adhesive, and creation of defined and desired pressure conditions on the platen and the sealing frame in every phase of the production process.

To let off the expanding steam using the pressure gradient from >0.5 N/mm$^2$ to 0 N/mm$^2$, the cross sections of the steam-bearing lines in the upper and lower press platens and their feed lines and removal lines as well as the control valves can be adapted to the greater volume of the diminishing steam pressure as well as the short expansion periods best for the process.

BRIEF DESCRIPTION OF THE DRAWINGS

Additional advantageous measures and embodiments of the subject matter of the invention will be found in the subordinate claims and the following description and drawing.

DETAILED DESCRIPTION OF PREFERRED EMBODIMENTS

Figure 1:
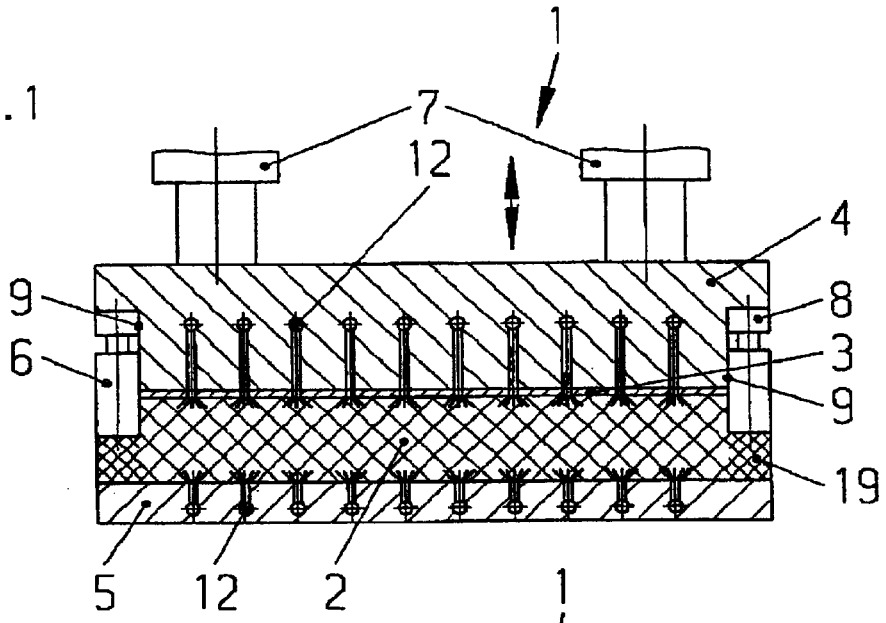
FIG. 1 is a schematic and sectional representation of the steam press according to the invention in a front view in the preliminary compression phase.
Figure 2:
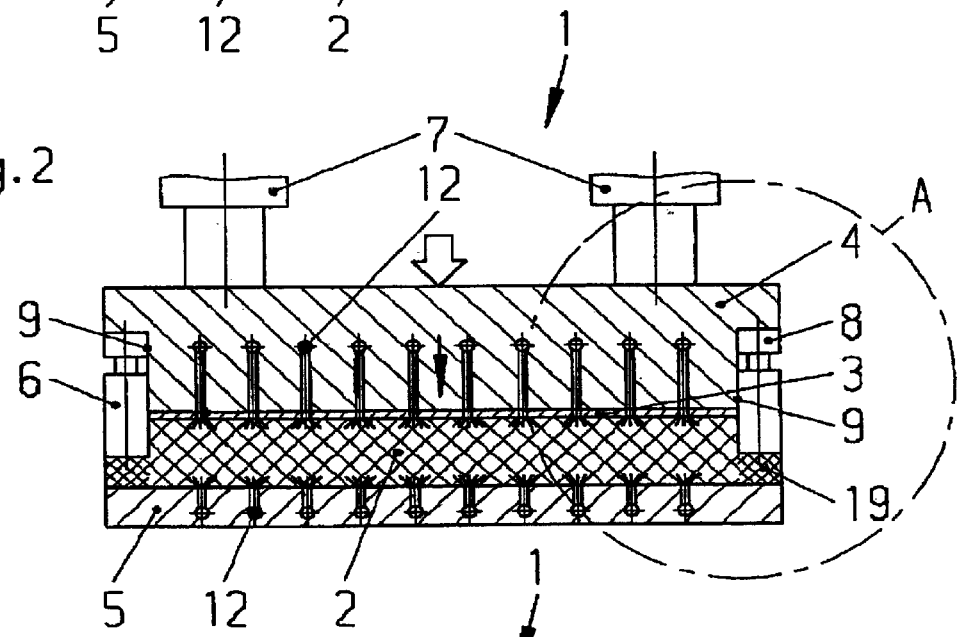
FIG. 2 shows the steam press of FIG. 1 in the pressing phase.
Figure 3:
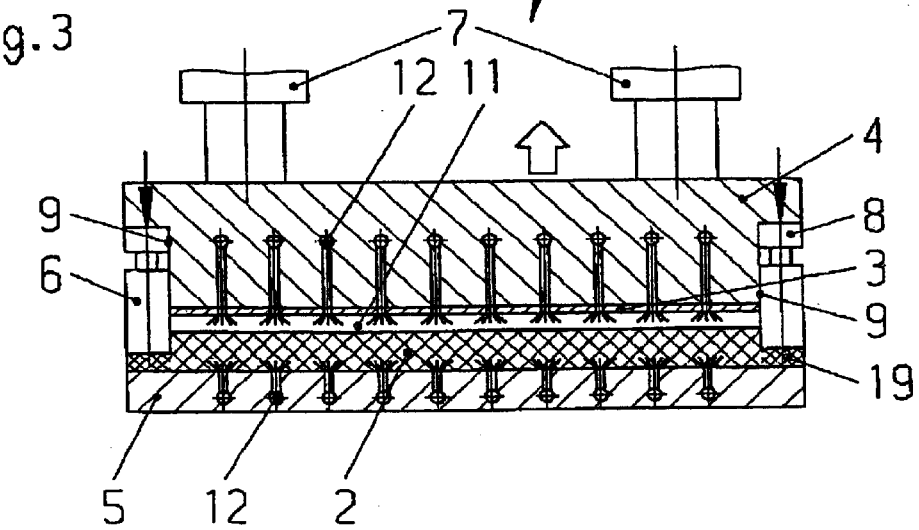
FIG. 3 shows the steam press of FIG. 1 in the expansion phase as the press chamber opens.
Figure 4:
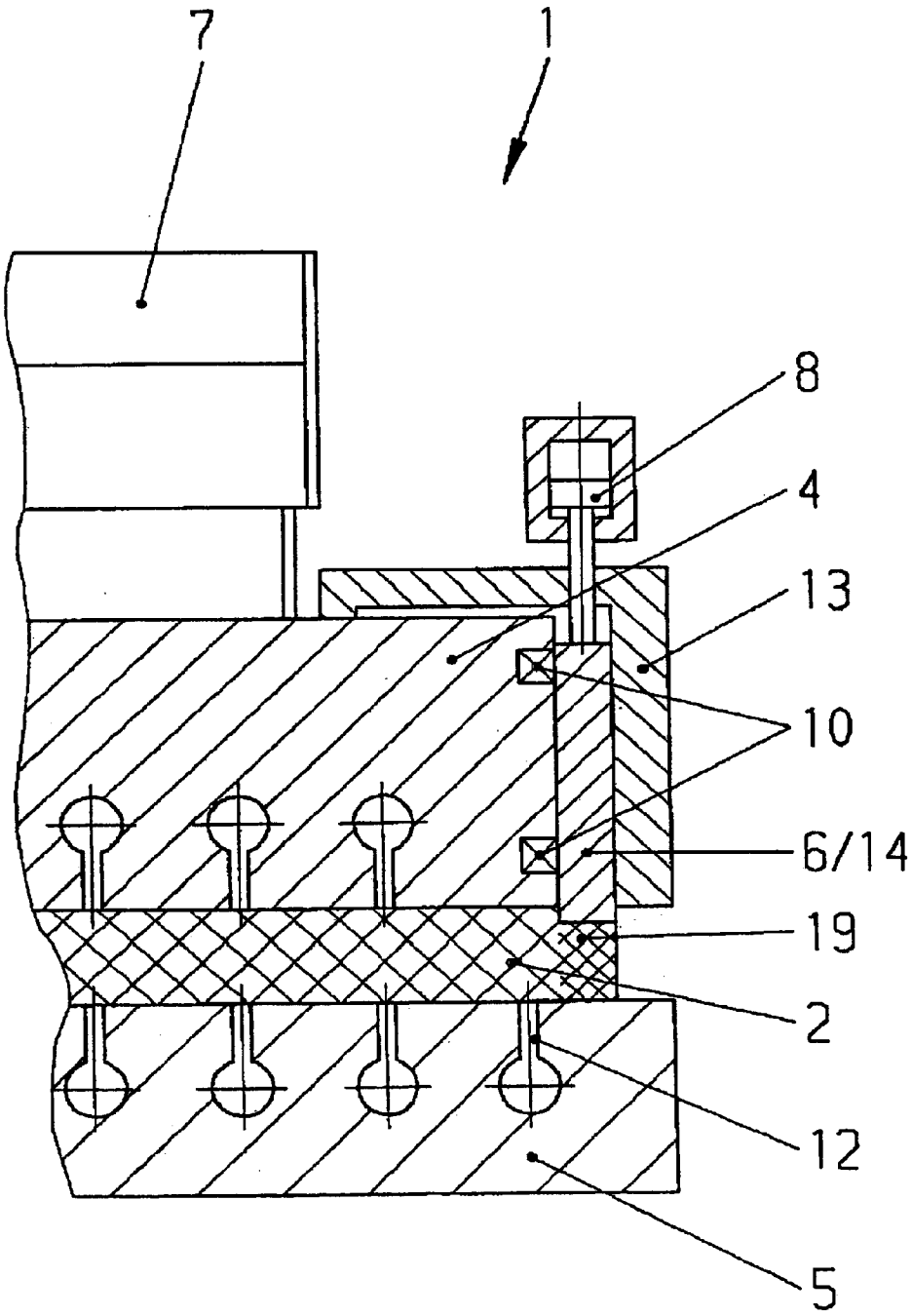
FIG. 4 shows the construction of the sealing frame with actuator in a section A from FIG. 2.
Figure 5:
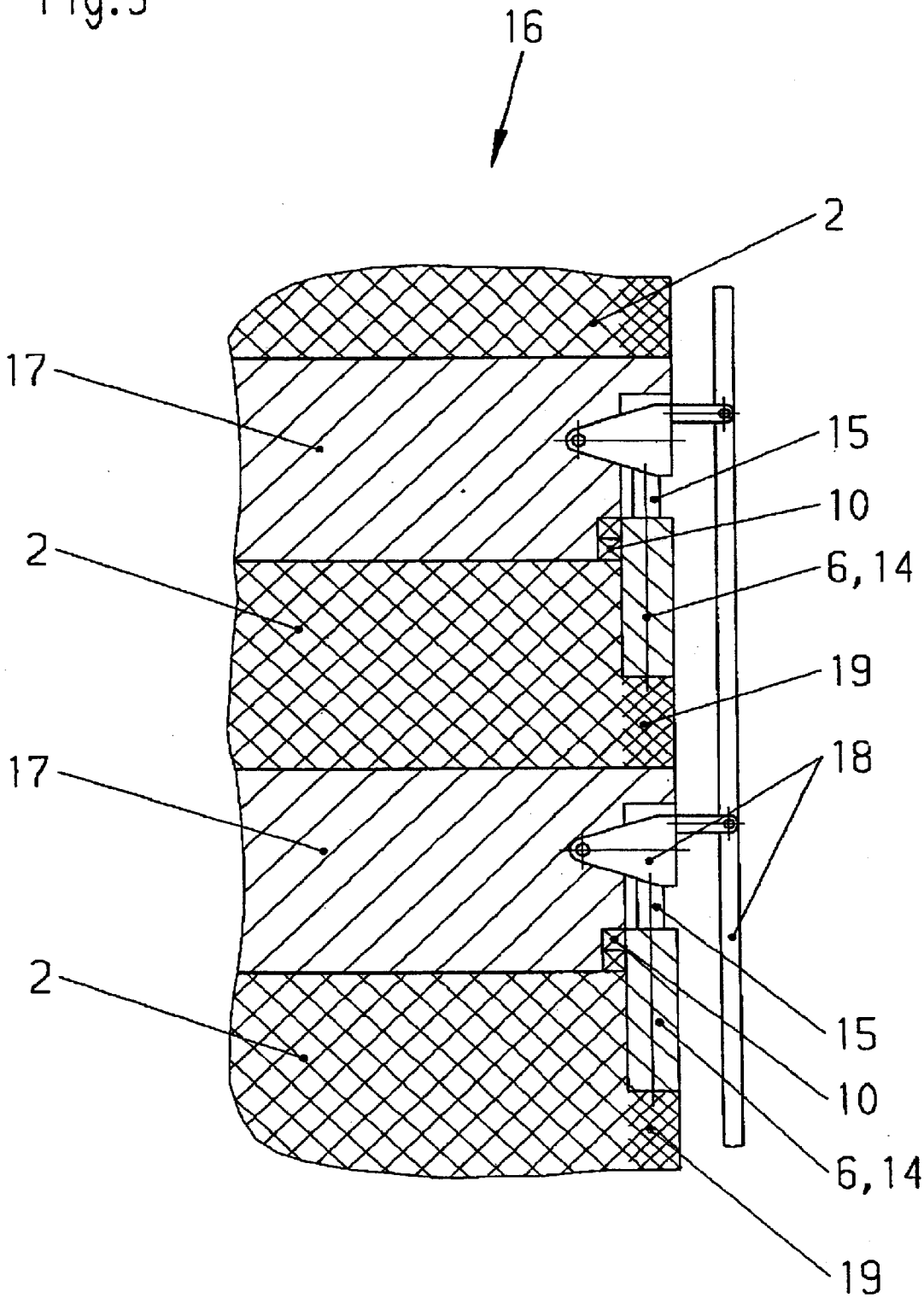
FIG. 5 is a fragmentary view of the construction of the sealing frame with actuator according to FIG. 4, in use in a multi-stage press.

The drawing shows in FIGS. 1 to 4 a diagrammatic representation of the steam press 1 of the invention in a single-stage design, and in FIG. 5 in a multi-stage design. The steam press 1 in the single-stage design is represented in the preliminary compression phase after the insertion of the mat 2 into the press chamber 11. The press chamber 11 is defined by the bottom, heated press platen 5, the upper press platen 4 which can be raised and lowered by means of the cylinder-and-piston system 7, and the sealing frame 6 with sealing bars 14. The sealing frame 6 with sealing bars 14 moves up and down at the lateral walls 9 and seals (or gaskets) 10. During the pressing cycle the hydraulic jack system 7 applies the necessary compression pressure on the material mat 2. With the hydraulic jacks 8, the sealing pressure is applied to the sealing frame 6 and sealing bars 14 independently of the compression pressure, so that the outer margin 19 of the mat 2 seals off the press chamber 11 from the exterior as required. During the pressing cycle, steam flows through the openings 12 in the press platens 4 and 5 and the metal wire mesh 3 into the press chamber 11 and into the mat 2. FIG. 2 shows the steam press 1 in the pressing phase with the press chamber 11 closed on all sides, while in FIG. 3 the steam exhaust phase is represented with the press platen 4 moving upward, but sealing pressure is still applied to the margin 19. In FIG. 4 and section A the construction and the anchoring of the sealing mechanism to the movable upper press platen 4 can be seen, the sealing frame 6 with sealing bars 14 and the pistons of the hydraulic jacks 8 being carried on the press platen 4.

FIG. 5 shows a detail of a possible design of the steam press 1 according to the invention transferred to a multi-stage press 16. In this case the sealing frames 6 with sealing bars 14 are pressed by means of an articulation 18 and pistons 15 from the pressing platens 17 against the margin 19 of the mat 2.

According to one embodiment, the invention comprises a method for the production of ligneous material boards, such as chip boards, fiber boards and flake boards by pressing and curing a mat of the material treated with a thermosetting binding agent in a steam press, wherein the mat is introduced into the press chamber formed by two press platens of the steam press and the latter closes, while during the closing and pressing the mat is sealed from the main press area at an outer frame on the margin of the movable press platen, then steam is introduced into the press chamber through openings in at least one press platen, the compression pressure is applied and the mat is cured, then the steam press is opened and the finished board is removed from the press chamber, characterized by a positive separation of the press platen applying the compression pressure from the mat at the frame sealing the outer margin, so that the press pressure is applied independently of the necessary pressure for the sealing.

The compression pressure on the mat may be applied in the main press area by a first hydraulic circuit I and in the frame area by a second hydraulic circuit II, the first and second hydraulic circuits being operated by respective hydraulic control circuits in a pressure, time and motion program during the compression cycle. According to another embodiment, a steam press for the practice of the method of the invention comprises two heatable press platens enclosing the press chamber, between which the mat of material can be introduced and can be removed again as a ligneous material board by hydraulic jack systems after compression and curing, at least one of the press platens having openings for the inlet and outlet of steam for curing the mat, and the movable press platen is constructed at the outer margin with a frame reducing the press gap and joined to the press platen, characterized in that the frame is formed as a sealing frame 6 in contact with the lateral walls 9 of the movable press platen 4 and is movable up and down thereon by means of actuators 8, and that the sealing frame 6 can be operated in the pressure, time and motion program by the actuators 8 regardless of the application of compression pressure by the movable press platen 4.

Preferably, the sealing frame 6 and sealing bars 14 are constructed so as to seal the press chamber 11 steam-tight against the guiding frame 13 by gaskets 10 inserted into the lateral walls 9.

In a multi-stage design, each stage press platen 17 may be equipped with a sealing frame 6 or with four sealing bars 14, the sealing frame 6 and sealing bars 14 being operated simultaneously in the pressure, time and motion program by a linkage 18 independently of the application of compression pressure.

The priority document here, German patent application DE 199 57 265.8 filed Nov. 28, 1999 is hereby incorporated by reference.

What is claimed is:

1. A method for the production of a ligneous material board from a mat formed of a material treated with a thermosetting binding agent in a steam press, the method comprising the steps:

introducing the mat into a press chamber formed by a first press platen and a movable press platen;

closing the press chamber;

sealing the mat in a main press area by applying pressure at an outer margin of the mat;

introducing steam into the press chamber through openings in at least one of the two press platens;

compressing the mat using compression pressure;

curing the mat to yield a finished board;

opening the steam press; and removing the finished board from the press chamber, wherein the pressure applied at the outer margin of the mat is applied independently of the compression pressure, wherein the compression pressure applied to the mat is applied in the main press area by a first hydraulic circuit and in a frame area by a second hydraulic circuit, and wherein the first and second hydraulic circuits are operated by respective hydraulic control circuits during the step of compressing the mat using compression pressure.

2. The method according to claim 1, wherein the step of sealing the mat from a main press area includes establishing a steam-tight seal against a guiding frame by providing gaskets in lateral walls of the moveable press platen.

3. The method according to any of claims 1, or 2, further comprising the step of:

performing the method in a multi-stage press.

4. The method according to claim 1, wherein the ligneous material board is selected from the group consisting of chip board, fiber board, and flake board.

* * * * *